US006350722B2

(12) United States Patent
Skiles et al.

(10) Patent No.: US 6,350,722 B2
(45) **Date of Patent: *Feb. 26, 2002**

(54) HIGH-TEMPERATURE, WATER-BASED LUBRICANT AND PROCESS FOR MAKING THE SAME

(75) Inventors: Kenneth Skiles, Chicago; Peter L. Zaleski, Willow Springs; Michael A. Castro, Aurora, all of IL (US)

(73) Assignee: Superior Graphite Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/751,533

(22) Filed: Dec. 29, 2000

Related U.S. Application Data

(63) Continuation of application No. 09/196,372, filed on Nov. 19, 1998, now Pat. No. 6,169,059.

(51) Int. Cl.[7] ..... C10M 173/02; C10M 125/02

(52) U.S. Cl. ..... 508/115; 508/156; 106/38.23

(58) Field of Search ..... 508/115, 156; 106/38.23

(56) References Cited

U.S. PATENT DOCUMENTS

| | | | | |
|---|---|---|---|---|
| 154,130 | A | * | 8/1874 | Eggleston et al. |
| 3,635,637 | A | | 1/1972 | Bergendahl ..... 425/363 |
| 3,782,697 | A | * | 1/1974 | Karg |
| 3,962,162 | A | | 6/1976 | Schmank ..... 260/22 |
| 3,983,042 | A | | 9/1976 | Jain et al. ..... 252/18 |
| 3,988,095 | A | | 10/1976 | Mersch et al. ..... 425/237 |
| 4,037,303 | A | | 7/1977 | Rieschel ..... 29/420 |
| 4,071,368 | A | | 1/1978 | Jones ..... 106/38 |
| 4,123,971 | A | | 11/1978 | Bergendahl ..... 100/93 |
| 4,287,073 | A | * | 9/1981 | Jain et al. |
| 4,715,972 | A | * | 12/1987 | Pacholke |
| 4,808,324 | A | * | 2/1989 | Periard et al. |
| RE33,124 | E | * | 12/1989 | Singer |
| 5,039,435 | A | | 8/1991 | Hanano ..... 106/38.22 |
| 5,082,251 | A | | 1/1992 | Whipp ..... 266/142 |
| 5,185,032 | A | | 2/1993 | Whipp ..... 75/436 |
| 5,370,727 | A | | 12/1994 | Whipp ..... 75/436 |
| 5,376,161 | A | | 12/1994 | Bergendahl et al. ..... 75/436 |
| 5,407,179 | A | | 4/1995 | Whipp ..... 266/142 |

FOREIGN PATENT DOCUMENTS

| | | |
|---|---|---|
| GB | 1272617 | 5/1972 |
| GB | 1363893 | 8/1974 |

* cited by examiner

*Primary Examiner*—Jerry D. Johnson
(74) *Attorney, Agent, or Firm*—Cook, Alex, McFarron, Manzo, Cummings & Mehler, Ltd.

(57) ABSTRACT

A high-temperature lubricant comprising a water-base and minor effective amounts of borate, dextrin, graphite, xanthan gum, and an organic preservative. A powder for preparing a water-based high temperature lubricant is disclosed in which the powder comprises graphite and minor effective amounts of borate, dextrin, and xanthan gum. A continuous process for making the lubricant is also disclosed.

4 Claims, 2 Drawing Sheets

HIGH-TEMPERATURE, WATER-BASED LUBRICANT AND PROCESS FOR MAKING THE SAME

CROSS REFERENCE TO RELATED APPLICATION

This application is a continuation of application Ser. No. 09/196,372, filed Nov. 19, 1998, now U.S. Pat. No. 6,169,059, issuing Jan. 2, 2001.

This invention relates to a high-temperature, water-based lubricant and, more particularly, to a water-based graphite suspension useful in metal and mineral forming applications and a continuous process for making the same.

BACKGROUND OF THE INVENTION

Many metal-forming operations are performed at high temperature using dies, molds and the like. In such operations, lubricants and/or release agents are often used to reduce wear on the dies or molds and to prevent-the resulting metal products from sticking to the dies or molds.

For example, a fluidized iron ore reduction (FIOR) processing plant includes a hot briquetting assembly in which direct reduced iron (DRI) briquettes are formed using iron ore fines as a feed stock. Such a process is described in U.S. Pat. No. 5,082,251 to Whipp, which is herein incorporated by reference. The briquettes are resistant to oxidation during storage and shipping and can be easily handled and charged in steel-making operations. In the briquetting process, reduced iron ore fines, lumps, or pellets are typically metered from a storage drum into a briquetting machine, such as those generally described in U.S. Pat. No. 3,988,095 to Mersh et al. and U.K. Patent No. 1,272,617, both of which are incorporated by reference.

In a briquetting machine, the material to be briquetted is drawn in by rolls rotating in opposite directions and pressed into briquettes at the nip between the pair of rolls by means of briquette-shape molds or dies embedded in the rolls. The iron fines, lumps, or pellets enter a feed drum on the top of the briquetting machine and are forced between the two counter-rotating rolls by a feed screw. The rolls are equipped with briquette-shaped molds which compress the fines into briquettes. The compaction is achieved by a combination of the high pressure between the rolls and the high temperature of the iron feed (approximately 900° C.), which makes them more compressible. Roll temperatures range typically between approximately 200° to 450° C.

Pressure is maintained by means of hydraulic cylinders that exert force against one of the two rollers, one roller being fixed and the other being allowed to move in order to prevent breakage should a piece of metal pass through the machine. The briquettes leave the machine in a web and then are separated into individual briquettes. The briquettes may then be quenched in a water-filled tank and discharged onto a conveyor where the moisture is driven off by the heat remaining in the briquettes.

In the past, dry powdered graphite has been used as a release agent on the briquette rolls used for the DRI hot briquetting. However, the dry graphite has not proved satisfactory in that it does not consistently and uniformly stick to the rolls, resulting in inefficient application of the graphite and high loss of the graphite during the application, and a concomitant graphite dust control problem. Further, the dry graphite is also relatively abrasive, thus resulting in higher wear on the rolls than is desired.

Accordingly, it is an object of this invention to provide a metal working lubricant and release agent that will both minimize wear on the forming rolls and facilitate the release of the formed metal product.

It is a further object to provide such a lubricant that can be efficiently applied to the rolls.

It is a still further object to provide a continuous process for making such a lubricant.

SUMMARY OF THE INVENTION

These objects, as well as others which will become apparent upon reference to the following detailed description are accomplished by a high-temperature lubricant comprising a water-base and minor effective amounts of borate, dextrin, graphite, xanthan gum, and an organic preservative. Additionally, a powder for preparing a water-based, high-temperature lubricant is disclosed which comprises graphite and minor effective amounts of borate, dextrin, and xanthan gum. Ranges for the components and preferred embodiments are disclosed for both the liquid lubricant and the powder precursor, as well as processes for making the lubricant.

DESCRIPTION OF THE PREFERRED EMBODIMENT

Figure 1:
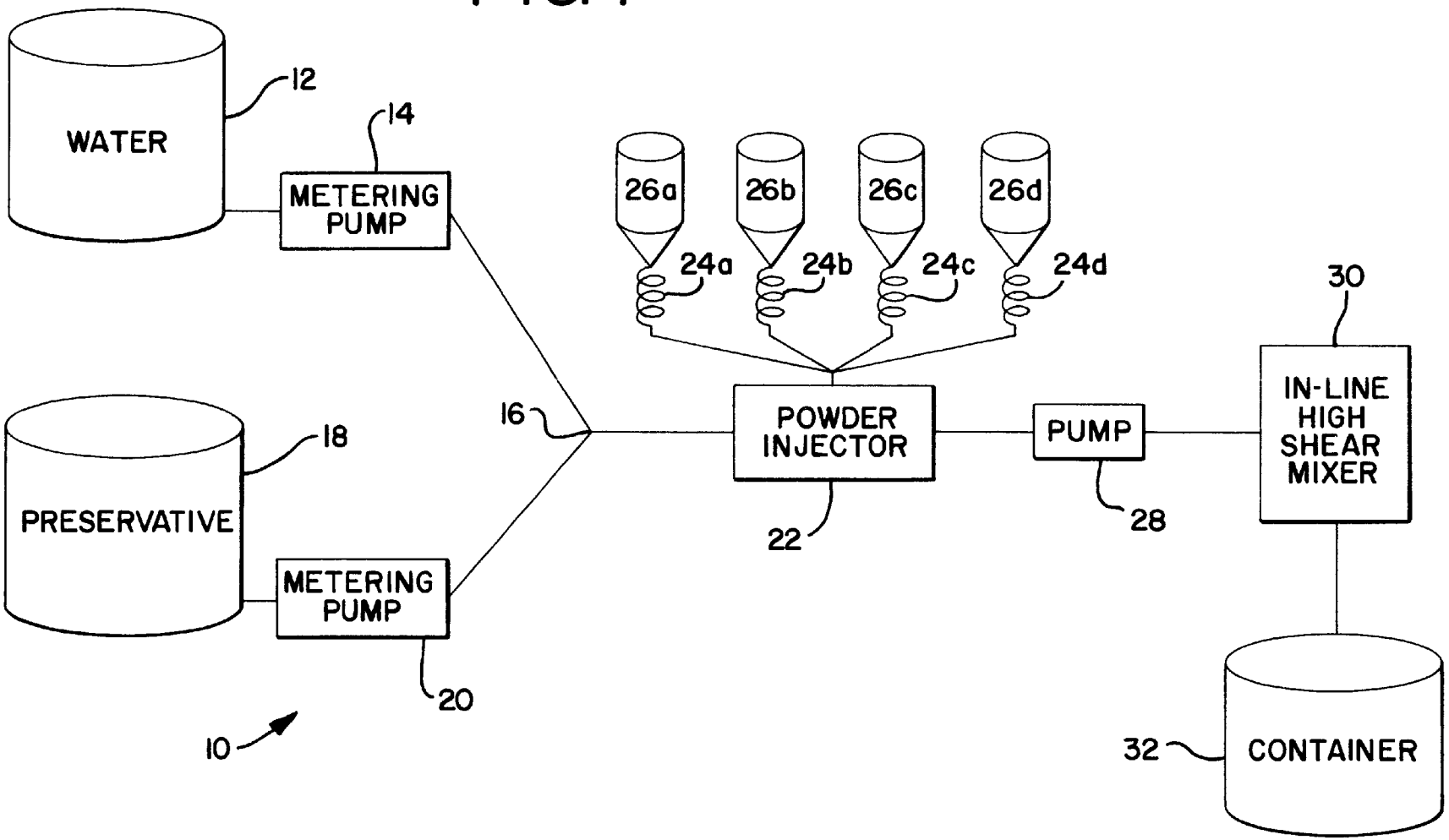
FIG. 1 is a schematic representation of a continuous process for making the lubricant of the present invention.

The high-temperature lubricant according to the present invention is exemplified by the following examples showing ranges for the various components expressed as a percent of the total weight.

TABLE 1

| Component | Low (wt %) | High (wt %) |
|---|---|---|
| Tap Water | 60.0 | 80.0 |
| Preservative | 0.1 | 0.3 |
| Borax | 0.1 | 1.0 |
| Dextrin | 5.0 | 15.0 |
| Graphite | 10.0 | 30.0 |
| Xanthan Gum | 0.1 | 0.4 |

The tap water can be any water of a quality suitable for industrial applications, and without harmful impurities. Its purpose is to carry the solid materials to the work zone and to lower the temperature of the die due to its evaporation.

The preservative can be any material classified as a preservative, such as a biocide, which is suitable for metal working fluids, paints, coatings, and/or suspensions. Its purposes is to protect the organic components of the suspension from micro-biological decomposition. Preferably, the preservative is a 50% solution of glutaraldehyde, such as Ucarcide 250 preservative available from Union Carbide or Ucar Carbon Company.

The borax may be any material from the inorganic borate chemical family and is preferably sodium tetraborate decahydrate, 10 mole powder. Its purpose is to control the pH of the suspension during storage and handling and to enhance lubricity. This material may be obtained from U.S. Borax Co.

The dextrin includes all materials from the dextrin chemical family, and is preferably greater than 90% soluble in water. With heat, dextrin cooks into a tacky adhesive and finally decomposes into carbon, gases and ash. Stadex 126 dextrin available from the Staley Co. has provided satisfactory results.

The graphite may be any material from the graphite chemical family, both natural and synthetic, and preferably has an average particle size of 30 microns, with a loss on ignition (LOI) of greater than or equal to 70%, and more preferably 95% and above. The graphite prevents adhesion between the iron briquettes and the briquette mold. In practice, 5033 synthetic graphite from Superior Graphite Co. has provided excellent results.

The xanthan gum may be any materials for xanthan gum chemical family and preferably has a average particle size of 175 microns. Xanthan gum is a suspension agent and prevents the solid particles from settling. The xanthan gum is available from Kelco under the trademark Kelzan.

The preferred composition for the lubricant is as follows:

TABLE 2

| Component | Wt % |
|---|---|
| Tap Water | 69.8 |
| Glutaraldehyde, 50% Solution | 0.2 |
| Borax, 10 mole powder | 0.5 |
| Dextrin, 95–100% water soluble | 10 |
| Synthetic Graphite | 19.3 |
| Xanthan Gum | 0.2 |

A powder for preparing a water-based, high temperature lubricant according to the present invention is set forth in the following Table 3, showing ranges for the various components as a percent of the total weight.

TABLE 3

| Component | Low (wt %) | High (wt %) |
|---|---|---|
| Borax | 0.5 | 2.0 |
| Dextrin | 31.0 | 34.0 |
| Graphite | 63.0 | 66.0 |
| Xanthan Gum | 0.5 | 1.0 |

The preferred composition for the powder is set forth in Table 4.

TABLE 4

| Components | Wt % |
|---|---|
| Borax, 10 mole powder | 1.7 |
| Dextrin, 95–100% water soluble | 33.3 |
| Synthetic Graphite | 64.3 |
| Xanthan Gum | 0.7 |

The lubricant may be made in a batch process using a tank and a propeller-type mixer. Preferably, the suspension is manufactured in A automated, continuous process, which helps to control costs through labor minimization, and the elimination of multiple start-up and shut down procedures.

In one such continuous process, the six raw materials, (the water, preservative, borax, dextrin, graphite and xanthan gum) are used. With reference to FIG. 1, there is seen a schematic representation of the process generally designated 10. The water is collected in a holding tank 12 and is pumped from the holding tank 12 by a metering pump 14 to a liquid injection point 16. A drum 18 containing the preservative is attached to a metering pump 20, and the preservative is combined with the water at the liquid injection point 16. The combined stream of preservative and water is fed into a powder injector 22. The graphite, dextrin, borax and xanthan gum are automatically unloaded from bulk bags, or similar bulk containers by screw conveyors 24*a*, 24*b*, 24*c*, and 24*d* which are associated with the feeder hoppers 26*a*, 26*b*, 26*c*, and 26*d*, respectively. The screw conveyors automatically meter the respective ingredients into the powder injector 22, which combines the water/preservative flow with the other ingredients with a minimum of air entrapment. The suspension is then transported from the powder injector 22 by a pump 28 to an in-line high shear mixer 30, which completely wets the insoluble solid particles and completely dissolves the soluble solids into the fluid. The suspension is then piped into a container 32, which may be, e.g., a tank truck or large capacity tank.

The ratio of the preservative to the water is controlled by the metering pumps 20, 14, while the ratio of the graphite, dextrin, borax, and xanthan gum is controlled by each component's screw feeder rate and the resulting pump rate from the water/preservative combination. The rates for the pumps 14, 20 and the screw feeders 24*a*, 24*b*, 24*c*, and 24*d* are controlled by computerized electronic motor frequency controls, which are well known. This general process may also be advantageously used for continuously making lubricating suspensions in which the lubricating particles are not graphite, but are other solid lubricants, e.g., borax, boron nitride, molybdenum disulfide, talc, etc. and the liquid in which the lubricating particles are suspended is either water, oil, or other hydrocarbons and/or solvents.

Figure 2:
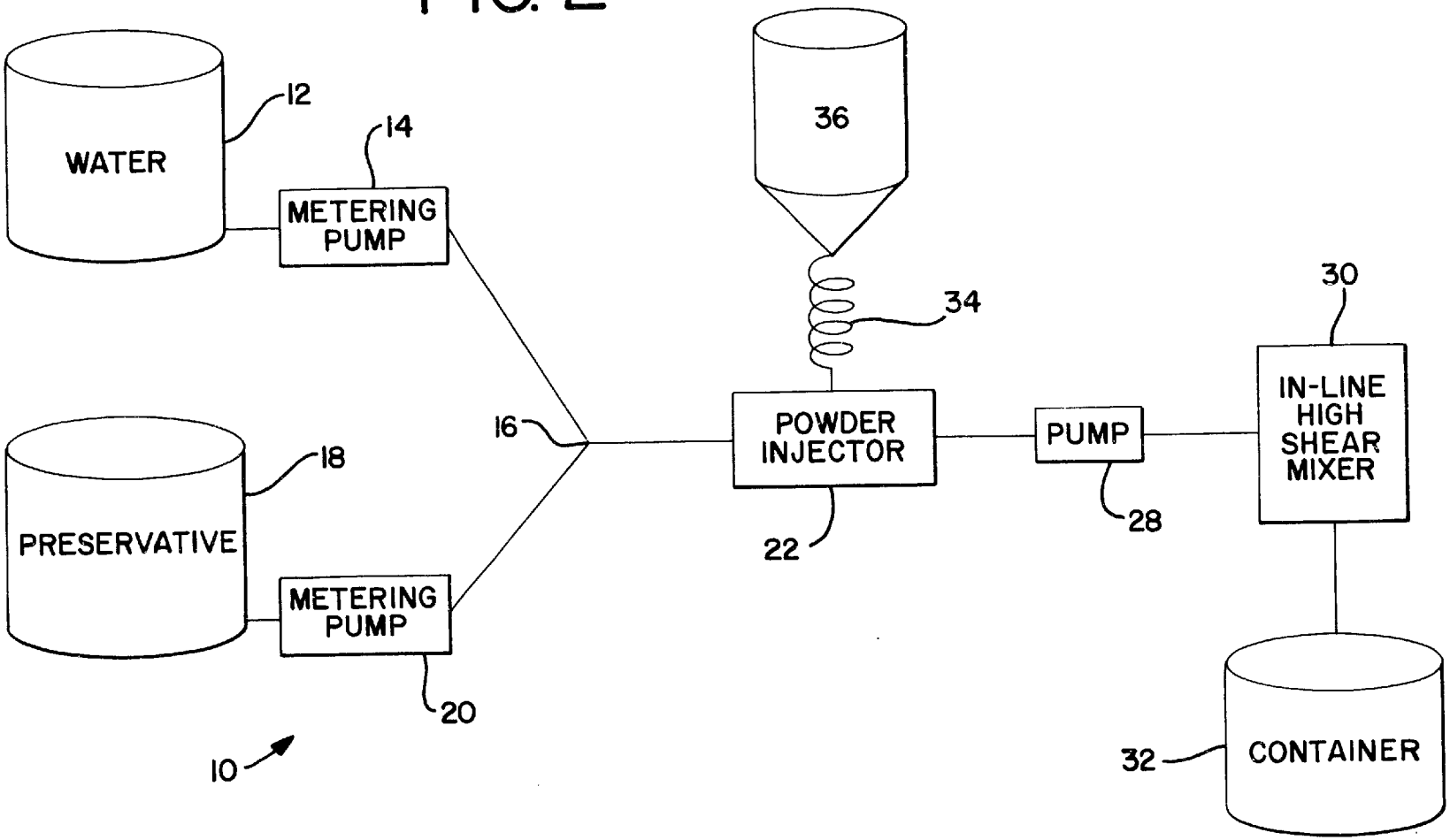
FIG. 2 is an alternative method to that shown in FIG. 1 for making the lubricant of the present invention.

In an alternative process, the dry ingredients (the graphite, dextrin, borax, and xanthan gum) are precombined and added to the water/preservative at the powder injector 22 from a single screw conveyor 34 and feeder hopper 36 (see, FIG. 2). In order to prepare the powder, a powder blender (not shown) is required. All the components are added to the blender and are blended together until a uniform mixture is achieved.

The water-based, suspended graphite lubricant described above has found particular utility in the hot briquetting of iron used in direct reduced iron processing plants. Application of the water-suspended lubricant directly to the dies by spraying has resulted in energy savings due to the reduction in torque energy needed to rotate the briquetting rolls and has extended roll life by reducing the friction between the rolls and the briquettes. The extended roll life has also increased production due to less down time and maintenance.

Spraying has proved to be an efficient method of applying the lubricant to the rolls, with the graphite lubricant binding to the roll surface after the carrier evaporates. Because the lubricant is water based, the evaporation of the carrier is environmentally safe. Further, the use of the water based suspension has reduced the graphite dust control problems associated with the use of dry powered graphite.

While the invention has been described as being particularly useful for the hot briquetting process, it should also prove equally useful as a die lubricant or mold release in forging and other hot metal and mineral forming operations.

That which is claimed:

1. A process for continuously making a water-based lubricant containing suspended graphite comprising:

supplying water at a controlled rate so as to comprise between about 60 wt % and 80 wt % of the lubricant by means of a first metering pump;

supplying a organic preservative at a controlled rate so as to comprise between about 0.1 wt. % and 0.2 wt % of the lubricant by means of a second metering pump;

combining the water and preservative and injecting the combined water and preservative into a powder injector;

introducing graphite, dextrin, borax, and xanthan gum so as to respectively comprise between about 10.0 wt % and 30.0 wt %, between about 5.0 wt % and 15.0 wt %, between about 0.1 wt % and 1.0 wt %, and between about 0.1 wt % and 0.4 wt % of the lubricant into the powder injector to combine them with the water and preservative;

pumping the water, preservative, graphite, dextrin, borax and xanthan gum into a higher shear mixer; and introducing the resulting suspension into a container.

2. The process of claim 1 wherein the graphite, dextrin, borax, and xanthan gum are introduced separately into the powder injector by means of separate metering screw feeders.

3. The process of claim 1 wherein the graphite, dextrin, borax, and xanthan gum are combined and introduced into the powder injector by means of a single metering screw feeder.

4. A process for continuously making a water-based lubricant containing suspended graphite comprising:

supplying water at a controlled rate by means of a first metering pump;

supplying a preservative at a controlled rate by means of a second metering pump;

combining the water and preservative and injecting the combined water and preservative into a powder injector;

introducing a powder comprising between about 0.5 wt. % and 2.0 wt. % of borate, between about 31.0 wt. % and 34.0 wt. % of dextrin, between about 63.0 wt. % and 66.0 wt. % graphite, and between about 0.5 wt. % and 1.0 wt. % xanthan gum into the powder injector to combine them with the water and preservative;

pumping the water, preservative, graphite, dextrin, borax and xanthan gum into a high shear mixer; and introducing the resulting suspension into a container.

* * * * *